US010366646B2

(12) United States Patent
Cho et al.

(10) Patent No.: US 10,366,646 B2
(45) Date of Patent: Jul. 30, 2019

(54) DEVICES INCLUDING FIRST AND SECOND BUFFERS, AND METHODS OF OPERATING DEVICES INCLUDING FIRST AND SECOND BUFFERS

(71) Applicants: Kyung-Sang Cho, Incheon (KR); Jae-Wook Lee, Suwon-si (KR); Chul-Ho Kim, Yongin-si (KR); Jin-Hyuk Lee, Seongnam-si (KR)

(72) Inventors: Kyung-Sang Cho, Incheon (KR); Jae-Wook Lee, Suwon-si (KR); Chul-Ho Kim, Yongin-si (KR); Jin-Hyuk Lee, Seongnam-si (KR)

(73) Assignee: Samsung Electronics Co., Ltd. (KR)

( * ) Notice: Subject to any disclaimer, the term of this patent is extended or adjusted under 35 U.S.C. 154(b) by 713 days.

(21) Appl. No.: 14/973,296

(22) Filed: Dec. 17, 2015

(65) Prior Publication Data

US 2016/0189583 A1 Jun. 30, 2016

(30) Foreign Application Priority Data

Dec. 26, 2014 (KR) ..... 10-2014-0190507

(51) Int. Cl.
*G09G 3/20* (2006.01)

(52) U.S. Cl.
CPC ..... *G09G 3/20* (2013.01); *G09G 2310/0275* (2013.01); *G09G 2330/021* (2013.01); *G09G 2360/18* (2013.01)

(58) Field of Classification Search
None
See application file for complete search history.

(56) References Cited

U.S. PATENT DOCUMENTS 5,446,496 A * 8/1995 Foster ..... G09G 5/005 345/531
6,320,986 B1 11/2001 Strohacker
6,411,302 B1 * 6/2002 Chiraz ..... G06F 3/1431 345/531
6,582,980 B2 * 6/2003 Feldman ..... G06F 3/147 345/205
6,778,457 B1 8/2004 Burgan
7,233,538 B1 6/2007 Wu et al.
(Continued)

OTHER PUBLICATIONS

"A low computing power frame rate converter", by Yu-Chieh Chen, Tai-Shan Liao, and Hsin Chen, 2012 IEEE International Instrumentation and Measurement Technology Conference Proceedings, pp. 1000-1003. (Year: 2012).*

(Continued)

*Primary Examiner* — James A Thompson
(74) *Attorney, Agent, or Firm* — Myers Bigel, P.A.

(57) ABSTRACT

Devices that include a logic circuit and first and second buffers are provided. The first buffer is spaced apart from the logic circuit by a first distance (and/or is refreshed in a first cycle), and the second buffer is spaced apart from the logic circuit by a second distance that is shorter than the first distance (and/or is refreshed in a second cycle that is different from the first cycle). Moreover, the logic circuit is configured to output, to the first buffer, first data corresponding to fewer toggles than second data that is output from the logic circuit to the second buffer. Methods of operating the devices are also provided.

15 Claims, 14 Drawing Sheets

(56) References Cited

U.S. PATENT DOCUMENTS

| | | | | |
|---|---|---|---|---|
| 7,929,368 | B2 | 4/2011 | Jeddeloh | |
| 8,588,017 | B2 | 11/2013 | Park et al. | |
| 2007/0222774 | A1* | 9/2007 | Foster | G06F 3/1431 345/204 |
| 2008/0158234 | A1* | 7/2008 | Kim | G09G 3/2096 345/501 |
| 2009/0027364 | A1* | 1/2009 | Kwan | G09G 3/20 345/204 |
| 2009/0073312 | A1* | 3/2009 | Lu | H04N 7/0132 348/451 |
| 2009/0079746 | A1* | 3/2009 | Howard | G06F 1/3218 345/502 |
| 2009/0167790 | A1* | 7/2009 | Lin | G09G 3/20 345/690 |
| 2010/0137035 | A1* | 6/2010 | Shan | G06F 1/3293 455/566 |
| 2010/0309185 | A1* | 12/2010 | Koester | G09G 3/32 345/211 |
| 2011/0037773 | A1* | 2/2011 | Ishioka | G09G 5/001 345/545 |
| 2011/0187730 | A1* | 8/2011 | Jun | G09G 3/36 345/545 |
| 2011/0234897 | A1* | 9/2011 | Yamamoto | G09G 3/3208 348/445 |
| 2012/0144106 | A1 | 6/2012 | Bains | |
| 2012/0154428 | A1 | 6/2012 | Barnhoefer | |
| 2013/0046934 | A1 | 2/2013 | Nychka et al. | |
| 2013/0287308 | A1 | 10/2013 | Salvucci | |
| 2014/0253537 | A1* | 9/2014 | Lee | G09G 5/12 345/214 |

OTHER PUBLICATIONS

Bahari et al., "Low Power Hardware Architecture for VBSME using Pixel Truncation", 21st International Conference on VLSI Design, Jan. 4-8, 2008, pp. 389-394 (6 pages).

Cho et al., "eDRAM-Based Tiered-Reliability Memory with Applications to Low-Power Frame Buffers", ISLPED'14, Aug. 11-13, 2014, pp. 333-338 (6 pages).

Gupta et al., "Video Steganography through LSB Based Hybrid Approach", International Journal of Scientific Research in Network Security and Communication, vol. 1, Issue 1, Mar.-Apr. 2013, pp. 7-13 (7 pages).

Liu et al., "RAIDR: Retention-Aware Intelligent DRAM Refresh", ISCA '12 Proceedings of the 39th Annual International Symposium on Computer Architecture, 2012, pp. 1-12 (12 pages).

Vamseekrishna et al., "Variable Block Size Motion Estimation using Pixel Truncation for H.264 Video Compression", International Journal of Advance Research in Computer Science and Management Studies, vol. 1, Issue 7, Dec. 2013, pp. 303-311 (9 pages).

Zhang, Xinpeng, "Separable Reversible Data Hiding in Encrypted Image", IEEE Transactions on Information Forensics and Security, vol. 7, No. 2, Apr. 2012, pp. 826-832 (7 pages).

* cited by examiner

DEVICES INCLUDING FIRST AND SECOND BUFFERS, AND METHODS OF OPERATING DEVICES INCLUDING FIRST AND SECOND BUFFERS

CROSS-REFERENCE TO RELATED APPLICATION

This application claims priority from Korean Patent Application No. 10-2014-0190507, filed on Dec. 26, 2014 in the Korean Intellectual Property Office, and all the benefits accruing therefrom under 35 U.S.C. 119, the contents of which are hereby incorporated herein by reference in their entirety.

BACKGROUND

The present disclosure relates to integrated circuit (IC) devices and methods of operating IC devices. With increased portability and increased miniaturization of a variety of electronic products, along with various other technological advances, there has been demand for advancements in display driver integrated circuits (DDIs) for driving a display panel.

For example, along with the increased portability of electronic products, there has been demand to use batteries as power sources for many electronic products. Thus, reduced power consumption by DDIs may be desirable. In addition, in view of the tendency toward miniaturization for electronic products, it may be desirable to reduce an area that a DDI occupies in an electronic product.

Accordingly, research into DDIs capable of reducing power consumption while achieving miniaturization may be beneficial.

SUMMARY

Various example embodiments of present inventive concepts may provide a semiconductor device having reduced power consumption. Moreover, some embodiments may provide a method for operating a semiconductor device having reduced power consumption. These and other objects of present inventive concepts will be described in, or be apparent from, the following description of example embodiments.

According to various embodiments of present inventive concepts, a semiconductor device is provided that includes a logic circuit configured to receive and buffer image data, and to output the image data that is buffered to a display. The semiconductor device includes first and second frame buffers. The first frame buffer may be connected to the logic circuit through a first line having a first length, and the second frame buffer may be connected to the logic circuit through a second line having a second length longer than the first length. Moreover, the semiconductor device may include conversion circuitry configured to convert the image data into conversion data and to provide the conversion data to the first and second frame buffers. The image data may include first image data having first and second bit sets different from each other and second image data having third and fourth bit sets different from each other. The conversion circuitry may be configured to receive the image data and to convert the image data into first conversion data including the first bit set and the third bit set, and into second conversion data including the second bit set and the fourth bit set. The first conversion data may be stored in the first frame buffer, and the second conversion data may be stored in the second frame buffer.

In various embodiments, the second bit set may include upper bits of the first bit set, and the fourth bit set may include upper bits of the third bit set. In some embodiments, the first bit set may include a least significant bit (LSB) set of the first image data, the second bit set may include a most significant bit (MSB) set of the first image data, the third bit set may include an LSB set of the second image data, and the fourth bit set may include an MSB set of the second image data. In some embodiments, equal numbers of bits may be included in the first bit set and the third bit set, and equal numbers of bits may be included in the second bit set and the fourth bit set.

According to various embodiments, the first frame buffer may be at one side of the logic circuit, and the second frame buffer may be at the one side of the logic circuit and may be farther than the first frame buffer from the logic circuit. Moreover, the semiconductor device may include third and fourth frame buffers at another side of the logic circuit. The third frame buffer may be connected to the logic circuit through a third line having a third length shorter than the second length. The first image data may include a fifth bit set having upper bits of the first bit set and lower bits of the second bit set. The second image data may include a sixth bit set having upper bits of the third bit set and lower bits of the fourth bit set. The conversion circuitry may be configured to receive the image data and to convert the image into third conversion data including the fifth bit set and the sixth bit set, and the third conversion data may be stored in the third frame buffer.

In various embodiments, the conversion circuitry may include a first flip-flop group configured to receive the first bit set of the first image data and the third bit set of the second image data and to output the first bit set of the first image data and the third bit set of the second image data as the first conversion data. Moreover, the conversion circuitry may include a second flip-flop group configured to receive the second bit set of the first image data and the fourth bit set of the second image data and to output the second bit set of the first image data and the fourth bit set of the second image data as the second conversion data. In some embodiments, the conversion circuitry may be within the logic circuit.

According to various embodiments, the semiconductor device may include a display driver integrated circuit (DDI). Moreover, in some embodiments, the image data may be supplied from an application processor (AP). Additionally or alternatively, the first conversion data stored in the first frame buffer may be refreshed in a first cycle, and the second conversion data stored in the second frame buffer may be refreshed in a second cycle longer than the first cycle.

A semiconductor device, according to various embodiments, may include a logic circuit configured to receive and buffer image data, and to output the image data that is buffered to a display. The semiconductor device may include first and second frame buffers. The first frame buffer may include data refreshed in a first cycle, and the second frame buffer may include data refreshed in a second cycle longer than the first cycle. Moreover, the semiconductor device may include conversion circuitry configured to convert the image data into conversion data, and to supply the conversion data to the first and second frame buffers. The image data may include first image data including first and second bit sets different from each other and second image data including third and fourth bit sets different from each other.

The first conversion data may be stored in the first frame buffer, and the second conversion data may be stored in the second frame buffer.

In various embodiments, the second bit set may include upper bits of the first bit set, and the fourth bit set may include upper bits of the third bit set. In some embodiments, the first and third bit sets may include payload information, and the second and fourth bit sets may include header information.

According to various embodiments, the semiconductor device may include a third frame buffer configured to store data refreshed in a third cycle longer than the first cycle and shorter than the second cycle. The first image data may include a fifth bit set including upper bits of the first bit set and lower bits of the second bit set. The second image data may include a sixth bit set including upper bits of the third bit set and lower bits of the fourth bit set. The conversion circuitry may be configured to receive the image data and to convert the image data into third conversion data including the fifth bit set and the sixth bit set. The third conversion data may be stored in the third frame buffer. In some embodiments, the first frame buffer may be connected to the logic circuit through a first line having a first length, and the second frame buffer may be connected to the logic circuit through a second line having a second length longer than the first length.

A semiconductor device, according to various embodiments, may include an application processor (AP). Moreover, the semiconductor device may include a display driver integrated circuit (DDI) including a logic circuit and first and second frame buffers. The DDI may be configured to receive first and second image data from the AP, to convert the first and second image data into first conversion data including lower bits of the first and second image data and into second conversion data including upper bits of the first and second image data, and to store the first conversion data in the first frame buffer and the second conversion data in the second frame buffer. At least one of a distance from the logic circuit to the first and second frame buffers and a refresh cycle for the first and second conversion data stored in the first and second frame buffers may be different.

In various embodiments, the DDI may include third and fourth frame buffers. The DDI may be configured to receive third and fourth image data from the AP. The DDI may be configured to convert the third and fourth image data into first conversion data including Least Significant Bits (LSBs) of the first to fourth image data, into second conversion data including lower bits of the first to fourth image data, into third conversion data including upper bits of the first to fourth image data, and into fourth conversion data including Most Significant Bits (MSBs) of the first to fourth image data. Moreover, the DDI may be configured to store the first to fourth conversion data in the first to fourth frame buffers, respectively. Refresh cycles of the third and fourth frame buffers may be longer than refresh cycles of the first and second frame buffers.

According to various embodiments, the refresh cycle of the fourth frame buffer may be longer than the refresh cycle of the third frame buffer, and the refresh cycle of the second frame buffer may be longer than the refresh cycle of the first frame buffer.

In various embodiments, the DDI may include third and fourth frame buffers. The DDI may be configured to receive third and fourth image data from the AP. The DDI may be configured to convert the received image data into first conversion data including Least Significant Bits (LSBs) of the first to fourth image data, into second conversion data including lower bits of the first to fourth image data, into third conversion data including upper bits of the first to fourth image data, and into fourth conversion data including Most Significant Bits (MSBs) of the first to fourth image data. The DDI may be configured to store the first to fourth conversion data in the first to fourth frame buffers, respectively. Moreover, a distance between each of the third and fourth frame buffers and the logic circuit may be longer than a distance between each of the first and second frame buffers and the logic circuit. In some embodiments, the distance between the third frame buffer and the logic circuit may be shorter than the distance between the fourth frame buffer and the logic circuit, and the distance between the first frame buffer and the logic circuit may be shorter than the distance between the second frame buffer and the logic circuit.

According to various embodiments, a refresh cycle of the second frame buffer may be longer than a refresh cycle of the first frame buffer. Additionally or alternatively, the second frame buffer may be farther than the first frame buffer from the logic circuit.

A method for operating a semiconductor device, according to various embodiments, may include receiving first image data including first and second bit sets different from each other and second image data including third and fourth bit sets different from each other. The method may include converting the first and second image data into first conversion data including the first and third bit sets and into second conversion data including the second and fourth bit sets. The method may include buffering the first conversion data using a first frame buffer including a first refresh cycle. The method may include buffering the second conversion data using a second frame buffer including a second refresh cycle different from the first refresh cycle. The method may include converting the first and second conversion data into the first and second image data. Moreover, the method may include outputting the first and second image data to a display.

In various embodiments, the second refresh cycle may be longer than the first refresh cycle, the second bit set may include upper bits of the first bit set, and the fourth bit set may include lower bits of the third bit set.

According to various embodiments, the second cycle may be longer than the first cycle, the first and third bit sets may include payload information, and the second and fourth bit sets may include header information.

An integrated circuit device, according to various embodiments, may include a logic circuit. The integrated circuit device may include a first buffer that is spaced apart from the logic circuit by a first distance. Moreover, the integrated circuit device may include a second buffer that is spaced apart from the logic circuit by a second distance that is shorter than the first distance. The logic circuit may be configured to output, to the first buffer, first data corresponding to fewer toggles than second data that is output from the logic circuit to the second buffer.

In various embodiments, the first data may be refreshed in the first buffer in a first cycle that is longer than a second cycle in which the second data may be refreshed in the second buffer. Additionally or alternatively, the device may include a display driver integrated circuit that is configured to electrically connect to a display, and the first and second buffers may be first and second frame buffers, respectively, of the display driver integrated circuit. The first and second data may include first and second converted image data, respectively. Moreover, the logic circuit may be configured to receive first and second image data. The logic circuit may be configured to combine a first Most Significant Bit (MSB)

of the first image data with a second MSB of the second image data. The logic circuit may be configured to combine a first Least Significant Bit (LSB) of the first image data with a second LSB of the second image data. The logic circuit may be configured to output the first and second MSBs, in the first converted image data or the second converted image data, to one of the first frame buffer and the second frame buffer. The logic circuit may be configured to output the first and second LSBs, in the first converted image data or the second converted image data, to a different one of the first frame buffer and the second frame buffer.

According to various embodiments, the logic circuit may be configured to output the first and second data to the first and second buffers, respectively, in response to determining that the second data is more likely to change than the first data.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

DETAILED DESCRIPTION

Figure 1:
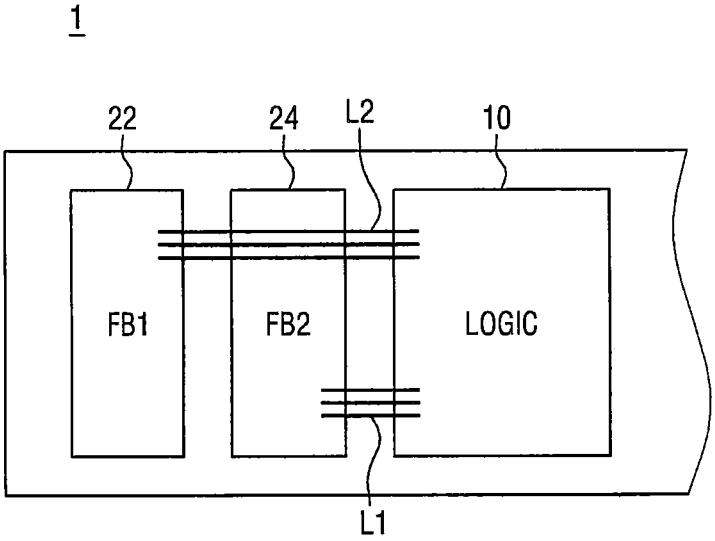
FIG. 1 is a block diagram of a semiconductor device according to some embodiments of present inventive concepts.

Example embodiments are described below with reference to the accompanying drawings. Many different forms and embodiments are possible without deviating from the spirit and teachings of this disclosure and so the disclosure should not be construed as limited to the example embodiments set forth herein. Rather, these example embodiments are provided so that this disclosure will be thorough and complete, and will convey the scope of the disclosure to those skilled in the art. In the drawings, the sizes and relative sizes of layers and regions may be exaggerated for clarity. Like reference numbers refer to like elements throughout the description.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of the stated features, steps, operations, elements, and/or components, but do not preclude the presence or addition of one or more other features, steps, operations, elements, components, and/or groups thereof.

It will be understood that when an element is referred to as being "coupled," "connected," or "responsive" to, or "on," another element, it can be directly coupled, connected, or responsive to, or on, the other element, or intervening elements may also be present. In contrast, when an element is referred to as being "directly coupled," "directly connected," or "directly responsive" to, or "directly on," another element, there are no intervening elements present. As used herein the term "and/or" includes any and all combinations of one or more of the associated listed items.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein may be interpreted accordingly.

It will be understood that although the terms "first," "second," etc. may be used herein to describe various elements, these elements should not be limited by these terms. These terms are only used to distinguish one element from another. Thus, a "first" element could be termed a "second" element without departing from the teachings of the present embodiments.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Hereinafter, a semiconductor device according to some embodiments of present inventive concepts will be described with reference to FIG. 1.

FIG. 1 is a block diagram of a semiconductor device 1 according to some embodiments of present inventive concepts.

Referring to FIG. 1, the semiconductor device 1 includes a logic circuit 10 and frame buffers 22 and 24. Hereinafter, semiconductor devices according to some embodiments of present inventive concepts will be described with regard to a display driver IC (DDI) used in outputting an image on a display unit (e.g., a display panel), but aspects of present inventive concepts are not limited thereto.

As shown in FIG. 1, the frame buffers 22 and 24 may be disposed at one side of the logic circuit 10 (e.g., the left side of the logic circuit 10).

The frame buffer 24 may be connected to the logic circuit 10 through a first line L1 having a first length and the frame buffer 22 may be connected to the logic circuit 10 through a second line L2 having a second length. Here, the first line L1 may be smaller/shorter than the second length L2. In other words, line resistance of the first line L1 may be smaller than that of the second line L2.

In some embodiments, the frame buffer 24 may be disposed to be closer than the frame buffer 22 to the logic circuit 10. That is to say, when the semiconductor device 1 is formed to elongate/extend in a left-right direction, as shown, the frame buffer 22 may be disposed to be farther than the frame buffer 24 from the logic circuit 10.

Accordingly, a distance between the frame buffer 24 and the logic circuit 10 may be smaller/shorter than a distance between the frame buffer 22 and the logic circuit 10.

For the sake of brevity and convenient explanation, in FIG. 1, only the logic circuit 10 and the frame buffers 22 and 24 are illustrated, but the semiconductor device 1 may include components other than those illustrated herein.

For example, in some embodiments, the semiconductor device 1 may further include an input pad for receiving image data from an external device (e.g., an application processor (AP)), and an output pad for outputting the image data buffered by the semiconductor device 1 to an external device (e.g., a display panel). In this case, the input pad and the output pad may be aligned at a top end or a bottom end of the semiconductor device 1 in one direction (e.g., in a horizontal direction).

The frame buffers 22 and 24 may be used in buffering image data. Accordingly, the frame buffers 22 and 24 may include storages for storing the image data.

In some embodiments, the frame buffers 22 and 24 may be implemented by, for example, memory devices. In particular, in some embodiments, the frame buffers 22 and 24 may be implemented by static random access memories (SRAMs), but aspects of present inventive concepts are not limited thereto. The frame buffers 22 and 24 may be implemented in various manners.

For example, in some embodiments, the frame buffers 22 and 24 may be implemented by other types of memory devices, such as a dynamic random access memory (DRAM), a magnetic random access memory (MRAM), a resistive random access memory (RRAM), or a phase change random access memory (PRAM).

Each of the illustrated frame buffers 22 and 24 may be a single memory device or a memory block including a plurality of memory devices. That is to say, the present inventive concepts do not limit the implementation types of the frame buffers 22 and 24 to those disclosed herein.

The logic circuit 10 may receive image data from an external device (e.g., an application processor (AP)), may buffer the image data using the frame buffers 22 and 24 and may output the buffered image data to an external device (e.g., a display panel).

Hereinafter, an example of the logic circuit 10 according to some embodiments of present inventive concepts will be described with reference to FIG. 2, but inventive concepts should not be construed as limited thereto.

Figure 2:
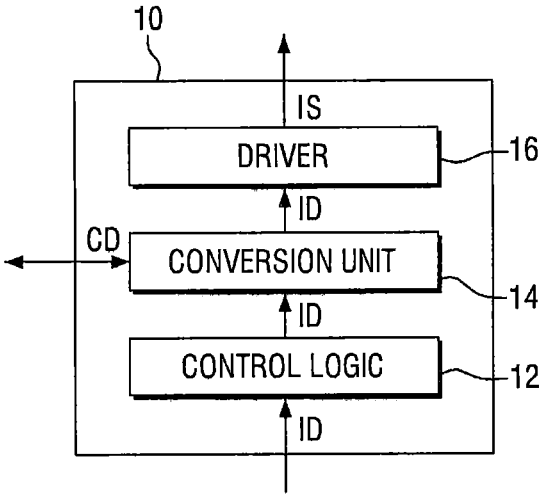
FIG. 2 is a detailed block diagram of a logic circuit of FIG. 1.

FIG. 2 is a detailed block diagram of a logic circuit of FIG. 1.

Referring to FIG. 2, the logic circuit 10 may include a control logic 12, a conversion unit 14 (e.g., including one or more conversion/convertor circuits referred to as "conversion circuitry"), and a driver 16.

The control logic 12 may receive image data ID from an external device (e.g., an application processor (AP) and may control the conversion unit 14 to convert the image data ID into conversion data CD.

In addition, the control logic 12 may buffer the conversion data CD using the frame buffers (22 and 24 of FIG. 1) and may control the conversion unit 14 to convert the buffered conversion data CD into image data ID to be output to the driver 16.

To emphasize a configuration of the conversion unit 14, the control logic 12 and the conversion unit 14 are separately illustrated in FIG. 2. However, in some embodiments, the conversion unit 14 may be disposed within the control logic 12. That is to say, the conversion unit 14 may be implemented such that it is incorporated with the control logic 12.

In addition, although the conversion unit 14 incorporated into the logic circuit 10 is illustrated in FIG. 2, aspects of present inventive concepts are not limited thereto. When necessary/desired, the conversion unit 14 may be separately constructed/implemented from the logic circuit 10.

The driver 16 may output the received image data ID to an external device (e.g., a display panel). Here, based on the received image data ID, the driver 16 may generate an image signal IS corresponding to the received image data ID and may output the generated image signal IS to an external device (e.g., a display panel).

In some embodiments, the driver 16 may be configured to include a source driver and a gate driver, but aspects of present inventive concepts are not limited thereto.

Hereinafter, an example of the conversion unit 14 according to some embodiments of present inventive concepts will be described with reference to FIG. 3, but inventive concepts should not be construed as limited thereto.

Figure 3:
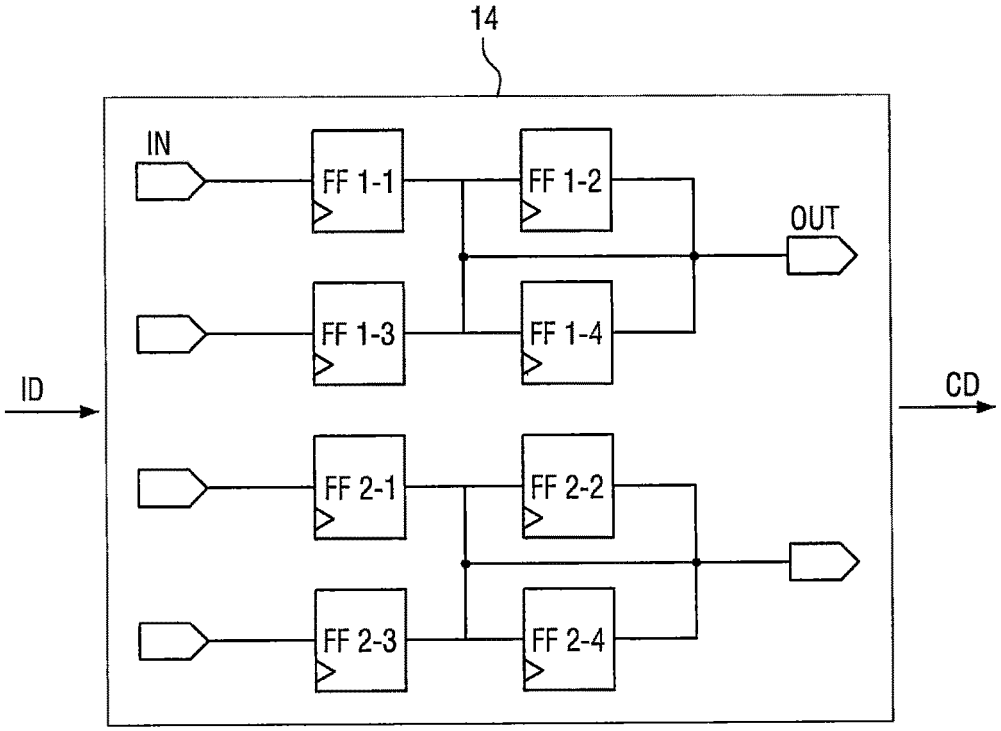
FIG. 3 is an example configuration of a conversion unit of FIG. 2.

FIG. 3 is an example configuration of a conversion unit of FIG. 2.

Referring to FIG. 3, the conversion unit 14 may include an input terminal IN, flip-flop groups FF1-1 to FF1-4 and FF2-1 to FF2-4, and an output terminal OUT.

The image data ID may be input to the input terminal IN from an external device (e.g., a control logic (12 of FIG. 2)).

The flip-flop groups FF1-1 to FF1-4 and FF2-1 to FF2-4 may latch a particular bit of the image data ID and may output the latched bit to the output terminal OUT at a predetermined timing to convert the image data ID into conversion data CD.

The output terminal OUT may supply the conversion data CD to an external device (e.g., the frame buffers (22 and 24 of FIG. 1).

Specific operations of the conversion unit 14 will later be described in detail.

Hereinafter, operations of a semiconductor device according to some embodiments of present inventive concepts will be described with reference to FIGS. 4 to 6.

Figure 4:
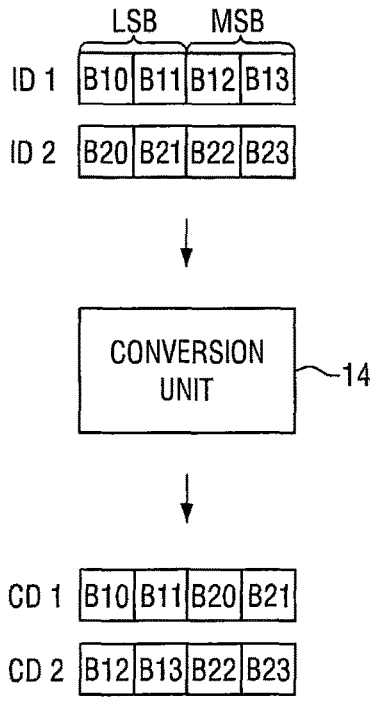
FIGS. 4 to 6 are diagrams for explaining operations of a semiconductor device according to some embodiments of present inventive concepts.
Figure 5:
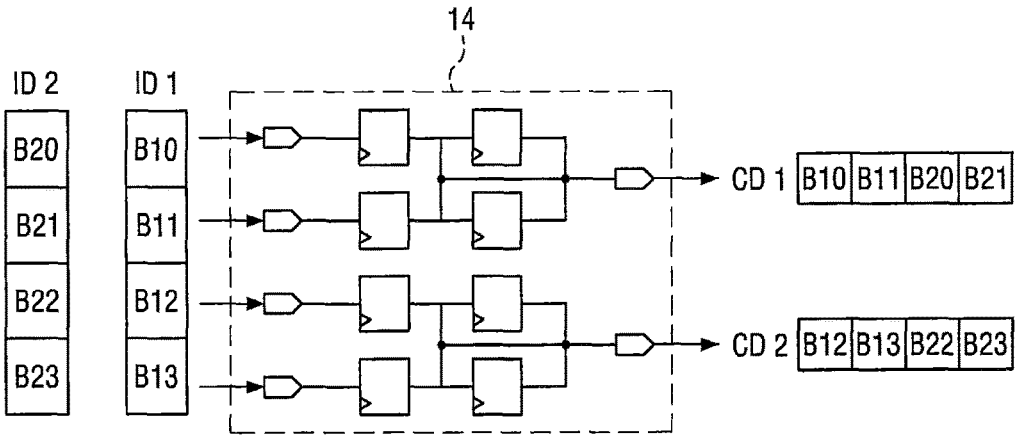
Figure 6:
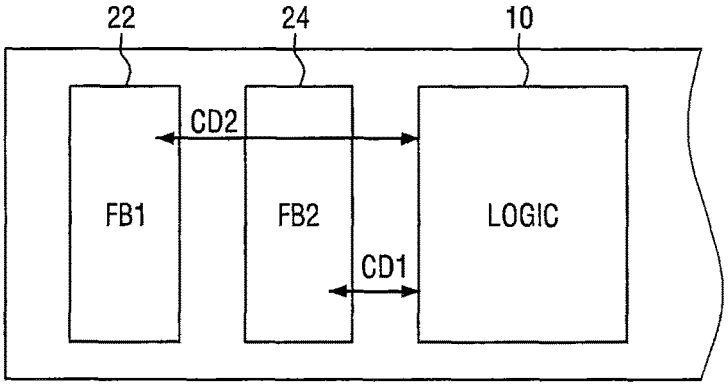

FIGS. 4 to 6 are diagrams for explaining operations of a semiconductor device according to some embodiments of present inventive concepts.

First, image data ID1 and ID2 may be supplied from an external device (e.g., an AP). In some embodiments, each of the image data ID1 and ID2 may be pixel data. That is to say, one of the image data ID1 and ID2 may be data required for implementing a pixel in a display unit.

In FIG. 4, for the sake of brevity and convenient explanation, each of the image data ID1 and ID2 including 4 bits is illustrated by way of example, but aspects of present inventive concepts are not limited thereto. The embodiments described herein may be modified in various manners.

The supplied image data ID1 and ID2 may be converted into conversion data CD1 and CD2 by the conversion unit 14. In detail, a least significant bit (LSB) set of the image data ID1 and a LSB set of the image data ID2 may be combined to generate the conversion data CD1, and a most significant bit (MSB) set of the image data ID1 and a MSB set of the image data ID2 may be combined to generate the conversion data CD2.

In detail, referring to FIGS. 3 and 5, when bits B10 to B13 of the image data ID1 and bits B20 to B23 of the image data ID2 are sequentially supplied to the conversion unit 14, flip-flops FF1-2, FF1-4, FF2-2, and FF2-4 may store the bits B10 to B13 of the image data ID1 and flip-flops FF1-1, FF1-3, FF2-1, and FF2-3 may store the bits B20 to B23 of the image data ID2.

Thereafter, the data stored in the flip-flops F1-1 to F1-4 may be output and combined, thereby generating the conversion data CD1 having a combination of the LSB set of the image data ID1 and the LSB set of the image data ID2, and the data stored in the flip-flops F2-1 to F2-4 may be output and combined, thereby generating the conversion data CD2 having a combination of the MSB set of the image data ID1 and the MSB set of the image data ID2. Although in FIG. 4, the MSB is the rightmost bit of the image data ID1 (or ID2), but in some embodiments, the MSB may be the leftmost bit of the image data ID1 (or ID2).

In FIGS. 4 and 5, one bit set including two bits is provided as an example, but aspects of present inventive concepts are not limited thereto. However, according to necessity/preference, the number of bits included in one bit set may vary in many ways.

For example, in some embodiments of present inventive concepts, one bit set may include one single bit. In addition, in some embodiments of present inventive concepts, one bit set may include four bits.

Next, referring to FIG. 6, the conversion data CD1 is stored in the frame buffer 24 and the conversion data CD2 is stored in the frame buffer 22.

When the data is buffered using the frame buffers 22 and 24 in the above-described manner, the magnitude of the power consumed by wires between the logic circuit 10 and the frame buffers 22 and 24 can be computed as follows:

$$P=CV^2 \cdot f \quad (1)$$

where C denotes capacitance of a wire, V denotes a voltage applied to the wire, and f denotes the number of toggles of data transmitted to the wire.

In the example shown in FIG. 1, the frame buffer 24 is connected to the logic circuit 10 through a first line L1 having a first length, and the frame buffer 22 is connected to the logic circuit 10 through a second line L2 having a second length greater than the first length.

The second line L2 electrically connecting the frame buffer 22 and the logic circuit 10 is longer than the first line L1 electrically connecting the frame buffer 24 and the logic circuit 10. Thus, assuming that the wires have the same width and have the same coupling effect, capacitance of the second line L2 is larger than that of the first line L1.

Therefore, to reduce the power consumed by the second line L2, it may be necessary/beneficial to transmit data having as small a number of toggles as possible through the second line L2. The term "toggle," as used herein, may refer to changing a bit from "0" to "1," or vice versa. Moreover, as used herein with respect to toggles, the term "fewer" may refer to a smaller quantity (e.g., a total that can be expressed as a natural number) of toggles. For example, if data through the second line L2 corresponds to "fewer" toggles than data through the first line L1, then it will be understood that the data through the second line L2 is changed from "0" to "1," or vice versa, a smaller total number of times (e.g., less frequently) than the data through the first line L1.

Therefore, in some embodiments, as shown in FIG. 6, the conversion data CD2 having a combination of a MSB set of the image data ID1 and a MSB set of the image data ID2 is stored in the frame buffer 22 through the second line (L2 of FIG. 1), and the conversion data CD1 having a combination of a LSB set of the image data ID1 and a LSB set of the image data ID2 is stored in the frame buffer 24 through the first line (L1 of FIG. 1).

Accordingly, a total of the power consumed by the first line (L1 of FIG. 1) and the second line (L2 of FIG. 1) may be reduced, compared to a case of randomly buffering the image data ID1 and ID2.

Meanwhile, to output the conversion data CD1 and CD2 stored in the frame buffers 22 and 24 on an external device (e.g., a display panel), the stored conversion data CD1 and CD2 may be reconverted into the image data ID1 and ID2.

In some embodiments, the re-converting may be performed by, for example, the conversion unit 14. Here, the conversion unit 14 may include a convertor circuit inversely performing the aforementioned conversion process.

Figure 7:
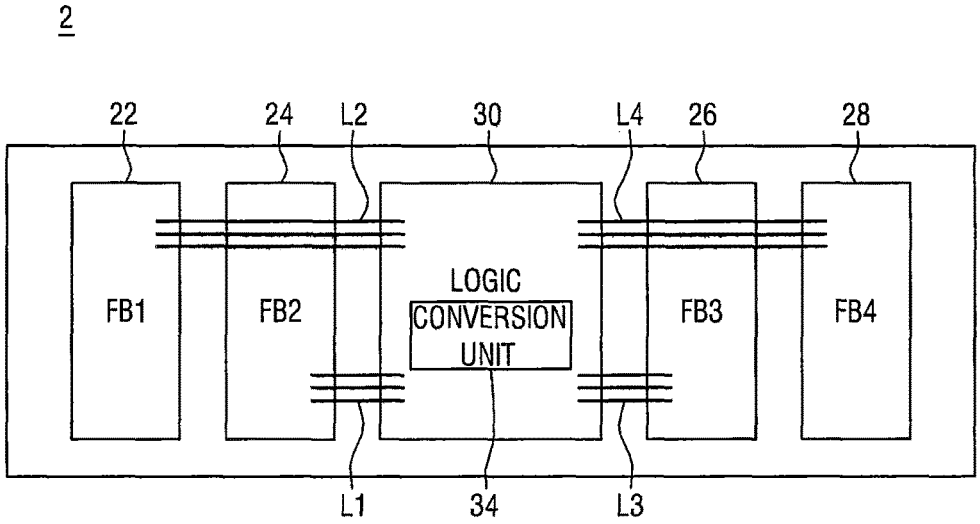
FIG. 7 is a block diagram of a semiconductor device according to some embodiments of present inventive concepts.

FIG. 7 is a block diagram of a semiconductor device (2) according to some embodiments of present inventive concepts. The following description will focus on differences between FIG. 1 and FIG. 7.

Referring to FIG. 7, the semiconductor device 2 includes a logic circuit 30 and frame buffers 22, 24, 26 and 28.

As shown in FIG. 7, the semiconductor device 2 according to the present embodiment may be formed to elongate/extend in a left-right direction. The frame buffers 22 and 24 may be disposed in the left side of the logic circuit 30 and the frame buffers 26 and 28 may be disposed in the right side of the logic circuit 30.

The frame buffer 24 may be connected to the logic circuit 30 through a first line L1 having a first length and the frame buffer 22 may be connected to the logic circuit 30 through a second line L2 having a second length. Here, the first line L1 may be smaller/shorter than the second length L2. Accordingly, line resistance of the first line L1 may be smaller than that of the second line L2.

The frame buffer 26 may be connected to the logic circuit 30 through a third line L3 having a third length. In the present embodiment, the third length may be smaller/shorter than the second length. Therefore, line resistance of the third line L3 may be smaller than that of the second line L2.

The frame buffer 28 may be connected to the logic circuit 30 through a fourth line L4 having a fourth length. Here, the third line L3 may be smaller than the fourth line L4. In other words, line resistance of the third line L3 may be smaller than that of the fourth line L4.

In some embodiments, the frame buffer 24 may be disposed to be closer than the frame buffer 22 to the logic circuit 30. That is to say, the frame buffer 22 may be disposed to be farther than the frame buffer 24 from the logic circuit 30.

Accordingly, a distance between the frame buffer 24 and the logic circuit 30 may be smaller/shorter than a distance between the frame buffer 22 and the logic circuit 30.

In addition, the frame buffer 26 may be disposed to be closer to the logic circuit 30 than the frame buffer 28. That is to say, the frame buffer 28 may be disposed to be farther from the logic circuit 30 than the frame buffer 26.

Accordingly, a distance between the frame buffer 26 and the logic circuit 30 may be smaller than a distance between the frame buffer 28 and the logic circuit 30.

The conversion unit 34 may convert image data into conversion data and may store the converted image data in the frame buffers 22, 24, 26 and 28.

Hereinafter, operations of a semiconductor device according to some embodiments of present inventive concepts will be described with reference to FIGS. 8 and 9.

Figure 8:
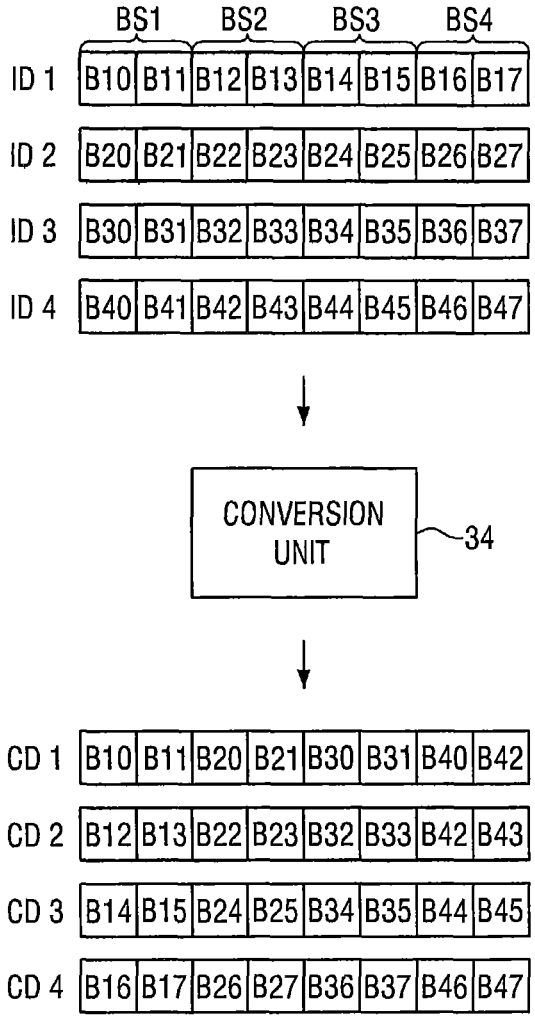
FIGS. 8 and 9 are diagrams for explaining operations of a semiconductor device according to some embodiments of present inventive concepts.
Figure 9:
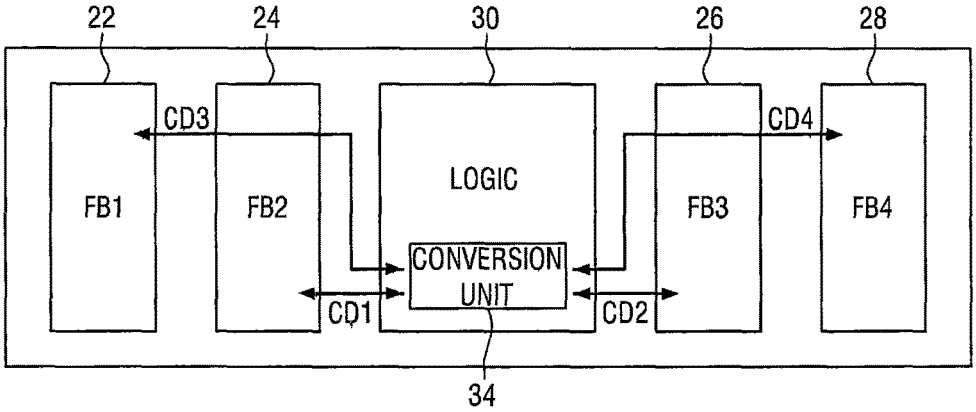

FIGS. 8 and 9 are diagrams for explaining operations of a semiconductor device according to some embodiments of present inventive concepts.

First, image data ID1, ID2, ID3, and ID4 may be supplied from an external device (e.g., an AP). In some embodiments, each of the image data ID1, ID2, ID3, and ID4 may be pixel data. That is to say, one of the image data ID1, ID2, ID3, and ID4 may be data required for implementing a pixel in a display unit.

For the sake of brevity and convenient explanation, each of the image data ID1, ID2, ID3, and ID4 including 8 bits is illustrated by way of example in FIG. 8, but aspects of present inventive concepts are not limited thereto. The embodiments described herein may be modified in various manners.

The supplied image data ID1, ID2, ID3, and ID4 may be converted into conversion data CD1, CD2, CD3, and CD4 by the conversion unit 34.

In detail, a first bit set BS1 of the image data ID1, ID2, ID3, and ID4 may be combined to generate the conversion data CD1, and a second bit set BS2 of the image data ID1, ID2, ID3, and ID4 may be combined to generate the conversion data CD2.

A third bit set BS3 of the image data ID1, ID2, ID3, and ID4 may be combined to generate the conversion data CD3, and a fourth bit set BS4 of the image data ID1, ID2, ID3, and ID4 may be combined to generate the conversion data CD4.

In some embodiments, as shown, the second bit set BS2 may be upper bits of the first bit set BS1, the third bit set BS3 may be upper bits of the second bit set BS2, and the fourth bit set BS4 may be upper bits of the third bit set BS3.

Here, numbers of bits included in the respective bit sets BS1 to BS4 may be equal to each other, but aspects of present inventive concepts are not limited thereto.

The conversion unit 34 performing the aforementioned operations may be implemented simply by modifying configurations of the conversion unit (14 of FIG. 3), and a detailed description thereof will not be repeated.

Referring to FIG. 9, the conversion data CD1 is stored in the frame buffer 24, the conversion data CD2 is stored in the frame buffer 26, the conversion data CD3 is stored in the frame buffer 22, and the conversion data CD4 is stored in the frame buffer 28.

As described above, in a case where the conversion data CD3 and CD4 consisting of upper bits and having a relatively small number of toggles are stored in the frame buffers 22 and 28 disposed to be relatively far from the logic circuit 30, and the conversion data CD1 and CD2 consisting of lower bits and having a relatively large number of toggles are stored in the frame buffers 24 and 26 disposed to be relatively close to the logic circuit 30, a total of the power consumed may be reduced, compared to a case of randomly storing data.

Figure 10:
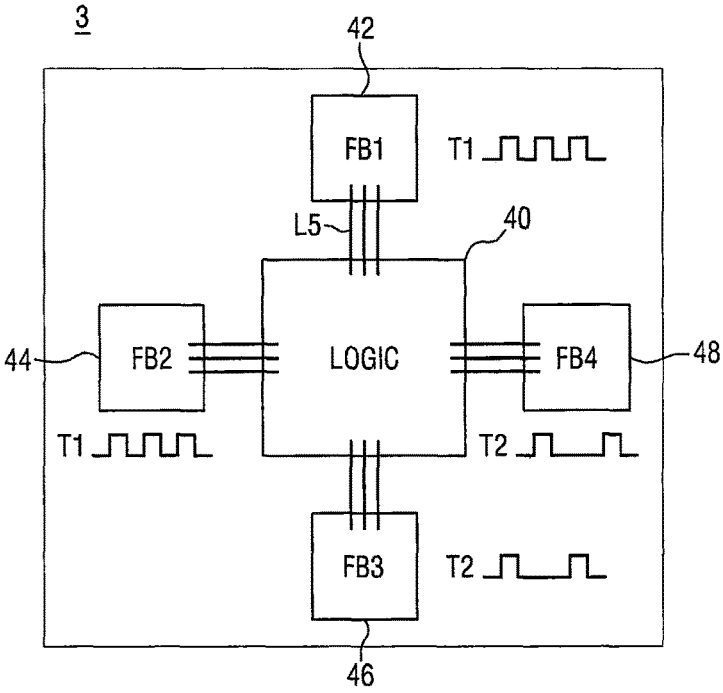
FIG. 10 is a block diagram of a semiconductor device according to some embodiments of present inventive concepts.

FIG. 10 is a block diagram of a semiconductor device (3) according to some embodiments of present inventive concepts. The following description will focus on differences between FIG. 10 and FIGS. 1-9.

Referring to FIG. 10, the semiconductor device 3 includes a logic circuit 40 and frame buffers 42, 44, 46, and 48.

In some embodiments, the frame buffers 42, 44, 46, and 48 may each be connected to the logic circuit 40 through a fifth line L5 having a fifth length. That is to say, in some embodiments, the frame buffers 42, 44, 46, and 48 may be equally spaced apart from the logic circuit 40.

In some embodiments, the frame buffers 42, 44, 46, and 48 may be implemented by, for example, DRAMs. Here, the data stored in the frame buffers 42 and 44 may be refreshed in a first cycle T1 and the data stored in the frame buffers 46 and 48 may be refreshed in a second cycle T2. Here, the second cycle T2 may be greater than the first cycle T1.

Figure 11:
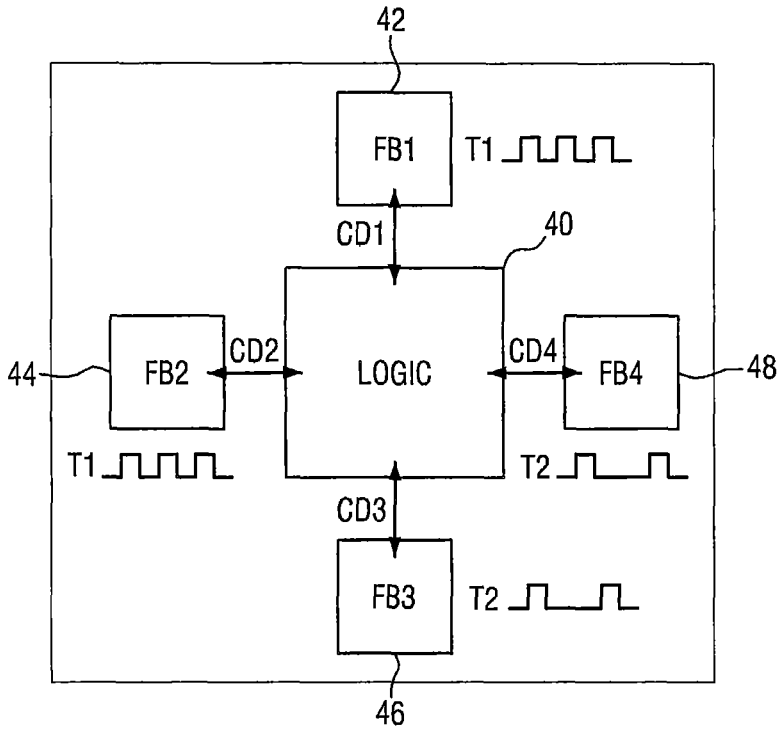
FIG. 11 is a diagram for explaining operations of a semiconductor device according to some embodiments of present inventive concepts.

FIG. 11 is a diagram for explaining operations of a semiconductor device according to some embodiments of present inventive concepts.

A conversion unit disposed in the logic circuit 40 may convert image data (ID1 to ID4 of FIG. 8) into conversion data (CD1 to CD4 of FIG. 8) and may store the conversion data CD1 to CD4 in the frame buffers 42, 44, 46, and 48, respectively.

Here, as shown, the conversion data CD1 may be stored in the frame buffer 42, the conversion data CD2 may be stored in the frame buffer 44, the conversion data CD3 may be stored in the frame buffer 46, and the conversion data CD4 may be stored in the frame buffer 48.

Since the conversion data CD3 and CD4 include bit sets (BS3 and BS4 of FIG. 8) consisting of upper bits having a relatively low probability of changing data when a frame is output to a display unit (e.g., a display panel), the quality of an image output to the display unit (e.g., the display panel) may not be considerably affected even if the data is lost during buffering.

However, since the conversion data CD1 and CD2 include bit sets (BS1 and BS2 of FIG. 8) consisting of lower bits having a relatively high probability of changing data when a frame is output to a display unit (e.g., a display panel), the quality of an image output to the display unit (e.g., the display panel) may be considerably affected if the data is lost during buffering.

Therefore, in the present embodiment, the conversion data CD3 and CD4 including bit sets (BS3 and BS4 of FIG. 8) consisting of upper bits having a relatively low probability of changing data when a frame is output to a display unit (e.g., a display panel) are stored in the frame buffers 46 and 48 refreshed in a second cycle T2, and the conversion data CD1 and CD2 including bit sets (BS1 and BS2 of FIG. 8) consisting of lower bits having a relatively high probability of changing data when a frame is output to a display unit (e.g., a display panel) are stored in the frame buffers 42 and 44 refreshed in a first cycle (Here, T1<T2).

Accordingly, power consumption of the semiconductor device 3 can be reduced while not considerably affecting the quality of the image output to a display unit (e.g., a display panel).

Meanwhile, although only the bit sets (BS3 and BS4 of FIG. 8) consisting of upper bits and the bit sets (BS1 and BS2 of FIG. 8) consisting of lower bits are illustrated in the present example, aspects of present inventive concepts are not limited thereto.

In some embodiments, the bit sets BS3 and BS4 may be configured to include header information and the bit sets BS1 and BS2 may be configured to include payload information.

In this case, the conversion data CD3 and CD4 including less important header information are stored in the frame buffers 46 and 48 refreshed in a second cycle T2, and the conversion data CD1 and CD2 including more important payload information than the header information are stored in the frame buffers 42 and 44 refreshed in a first cycle (Here, T1<T2), thereby reducing power consumption of the semiconductor device 3.

The header information and the payload information illustrated herein may be commonly applied to embodiments illustrated in FIGS. 12-20.

Figure 12:
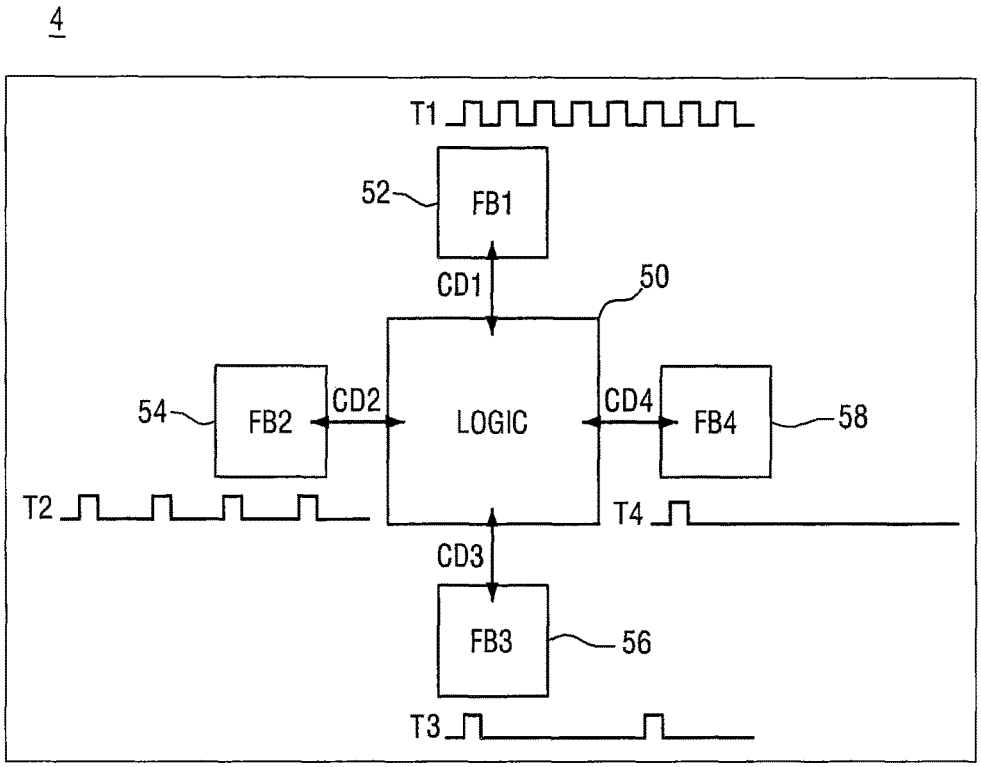
FIG. 12 is a block diagram of a semiconductor device according to some embodiments of present inventive concepts.

FIG. 12 is a block diagram of a semiconductor device (4) according to some embodiments of present inventive concepts. The following description will focus on differences between FIG. 12 and FIGS. 1-11.

Referring to FIG. 12, the semiconductor device 4 includes a logic circuit 50 and frame buffers 52, 54, 56, and 58.

In the present embodiment, the data stored in the frame buffer 52 may be refreshed in a first cycle T1, the data stored in the frame buffer 54 may be refreshed in a second cycle T2, the data stored in the frame buffer 56 may be refreshed in a third cycle T3, and the data stored in the frame buffer 58 may be refreshed in a fourth cycle T4.

Here, the second cycle T2 may be greater (e.g., longer) than the first cycle T1, the third cycle T3 may be greater than the second cycle T2, and the fourth cycle T4 may be greater than the third cycle T3.

A conversion unit disposed in the logic circuit 50 may convert image data (ID1 to ID4 of FIG. 8) into conversion data (CD1 to CD4 of FIG. 8) and may store the conversion data CD1 to CD4 in the frame buffers 52, 54, 56, and 58, respectively.

Here, as shown, the conversion data CD1 may be stored in the frame buffer 52, the conversion data CD2 may be stored in the frame buffer 54, the conversion data CD3 may be stored in the frame buffer 56, and the conversion data CD4 may be stored in the frame buffer 58.

In the present embodiment, the conversion data CD4 including a bit set (BS4 of FIG. 8) consisting of the MSB having a lowest probability of changing data when a frame is output to a display unit (e.g., a display panel) is stored in the frame buffer 58 refreshed in a fourth cycle T4, and the conversion data CD1 including a bit set (BS1 of FIG. 8) consisting of the LSB having a highest probability of changing data when a frame is output to a display unit (e.g., a display panel) is stored in the frame buffer 52 refreshed in a first cycle that is shortest among the first to fourth cycles T1 to T4, thereby reducing power consumption of the semiconductor device 4 while not considerably affecting the quality of the image output to a display unit (e.g., a display panel).

Figure 13:
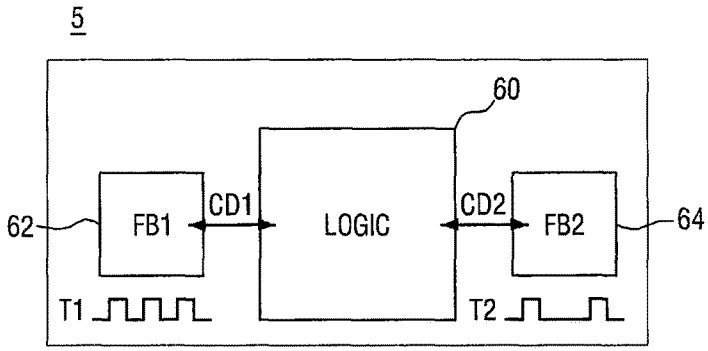
FIG. 13 is a block diagram of a semiconductor device according to some embodiments of present inventive concepts.

FIG. 13 is a block diagram of a semiconductor device (5) according to some embodiments of present inventive concepts. The following description will focus on differences between FIG. 13 and FIGS. 1-12.

Referring to FIG. 13, the semiconductor device 5 includes a logic circuit 60 and frame buffers 62 and 64.

In some embodiments, as shown in FIG. 13, the frame buffer 62 may be disposed in the left side of the logic circuit 60 and the frame buffer 64 may be disposed in the right side of the logic circuit 60. That is to say, the semiconductor device 5 may be formed to elongate/extend in a left-right direction.

The data stored in the frame buffer 62 may be refreshed in a first cycle T1 and the data stored in the frame buffer 64 may be refreshed in a second cycle T2. Here, the second cycle T2 may be greater than the first cycle T1.

A conversion unit disposed in the logic circuit 60 may convert image data (ID1 and ID2 of FIG. 4) into conversion data (CD1 and CD2 of FIG. 4) and may store the conversion data CD1 and CD2 in the frame buffers 62 and 64, respectively.

The conversion data CD1 including a LSB set may be stored in the frame buffer 62 refreshed in the first cycle T1, which is relatively short, and the conversion data CD2 including a MSB set may be stored in the frame buffer 64, which is relatively long. Accordingly, power consumption of the semiconductor device 5 can be reduced while not considerably affecting the quality of the image output to a display unit (e.g., a display panel).

Figure 14:
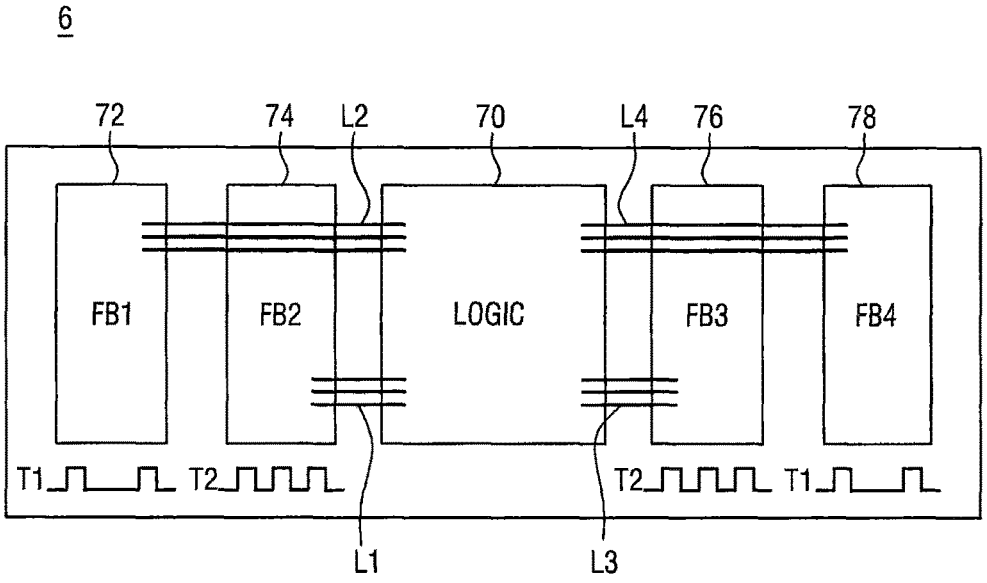
FIG. 14 is a block diagram of a semiconductor device according to some embodiments of present inventive concepts.

FIG. 14 is a block diagram of a semiconductor device according to some embodiments of present inventive concepts.

Referring to FIG. 14, the semiconductor device 6 includes a logic circuit 70 and frame buffers 72, 74, 76, and 78. Here, arrangement and connection structures between the logic circuit 70 and the frame buffers 72, 74, 76, and 78 are substantially the same as those of the semiconductor device 2, and a detailed description thereof will not be repeated.

In the present embodiment, the frame buffers 72, 74, 76, and 78 may be implemented by, for example, DRAMs. Here, the data stored in the frame buffers 72 and 78 may be refreshed in a first cycle T1 and the data stored in the frame buffers 74 and 76 may be refreshed in a second cycle T2. Here, the second cycle T2 may be smaller (e.g., shorter) than the first cycle T1.

Figure 15:
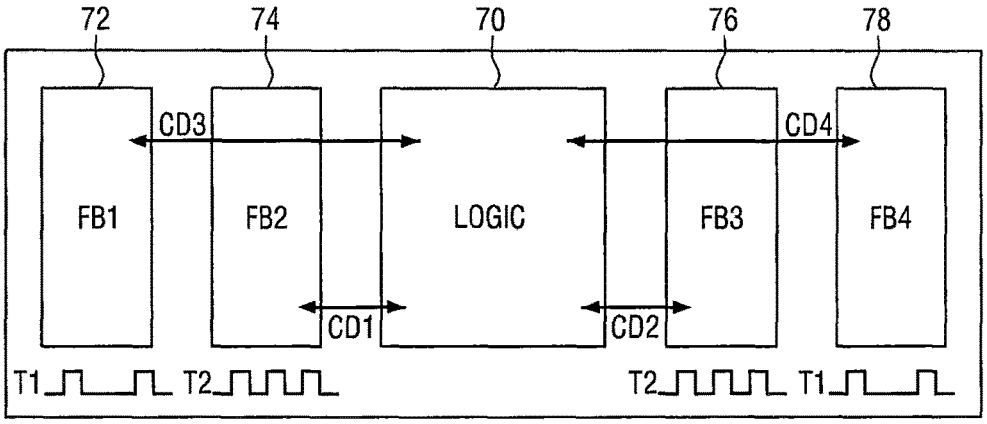
FIG. 15 is a diagram for explaining operations of a semiconductor device according to some embodiments of present inventive concepts.

FIG. 15 is a diagram for explaining operations of a semiconductor device according to some embodiments of present inventive concepts.

A conversion unit disposed in the logic circuit 70 may convert image data (ID1 to ID4 of FIG. 8) into conversion data (CD1 to CD4 of FIG. 8) and may store the conversion data CD1 to CD4 in the frame buffers 72, 74, 76, and 78, respectively.

Here, as shown, the conversion data CD1 may be stored in the frame buffer 74, the conversion data CD2 may be stored in the frame buffer 76, the conversion data CD3 may be stored in the frame buffer 72, and the conversion data CD4 may be stored in the frame buffer 78.

Since the conversion data CD3 and CD4 include bit sets (BS3 and BS4 of FIG. 8) consisting of upper bits having a relatively low probability of changing data when a frame is output to a display unit (e.g., a display panel), the quality of an image output to the display unit (e.g., the display panel) may not be considerably affected even if the data is lost during buffering.

However, since the conversion data CD1 and CD2 include bit sets (BS1 and BS2 of FIG. 8) consisting of lower bits having a relatively high probability of changing data when a frame is output to a display unit (e.g., a display panel), the quality of an image output to the display unit (e.g., the display panel) may be considerably affected if the data is lost during buffering.

Therefore, in some embodiments, the conversion data CD3 and CD4 including bit sets (BS3 and BS4 of FIG. 8) consisting of upper bits having a relatively low probability of changing data when a frame is output to a display unit (e.g., a display panel) are stored in the frame buffers 72 and 78 refreshed in a first cycle T2, which is relatively long, and the conversion data CD1 and CD2 including bit sets (BS1 and BS2 of FIG. 8) consisting of lower bits having a relatively high probability of changing data when a frame is output to a display unit (e.g., a display panel) are stored in the frame buffers 74 and 76 refreshed in a second cycle T2, which is relatively short.

Accordingly, power consumption of the semiconductor device 6 can be reduced while not considerably affecting the quality of the image output to a display unit (e.g., a display panel).

In addition, the conversion data CD3 and CD4 consisting of upper bits and having a relatively small number of toggles are stored in the frame buffers 72 and 78 disposed to be relatively far from the logic circuit 70, and the conversion data CD1 and CD2 consisting of lower bits and having a relatively large number of toggles are stored in the frame buffers 74 and 76 disposed to be relatively close to the logic circuit 70, a total of the power consumed may be reduced, compared to a case of randomly storing data.

Figure 16:
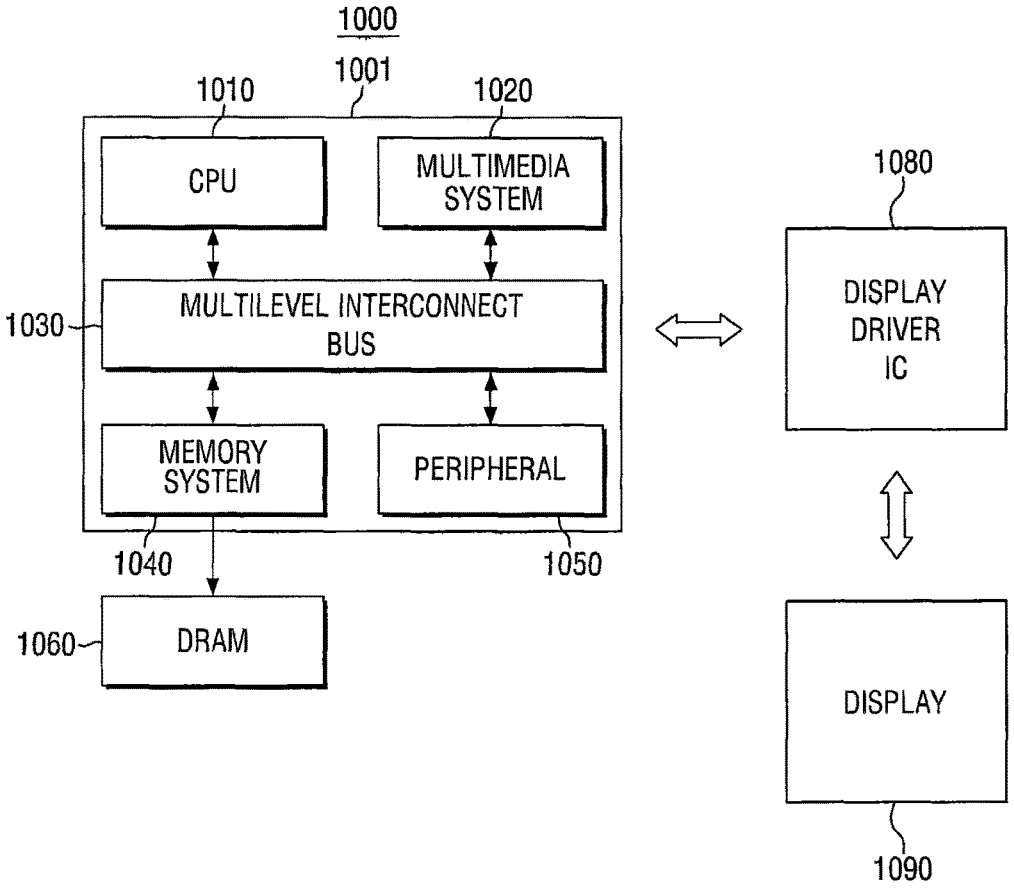
FIG. 16 is a block diagram of a semiconductor device according to some embodiments of present inventive concepts.

FIG. 16 is a block diagram of a semiconductor device 1000 according to some embodiments of present inventive concepts.

Referring to FIG. 16, the semiconductor device 1000 may include an application processor (AP) 1001, a display driver IC (DDI) 1080, and a display unit 1090.

The application processor 1001 may include a central processing unit (CPU) 1010, a multimedia system 1020, a bus (e.g., a multilevel interconnect bus 1030), a memory system 1040, and a peripheral circuit 1050.

The CPU 1010 may execute computations required to drive the semiconductor device 1000. In some embodiments, the CPU 1010 may be configured by multi-core environments including a plurality of cores. In more detail, the CPU 1010 may be implemented by a big cluster including a plurality of large-capacity cores, and a smaller cluster including a plurality of small-capacity cores, but aspects of present inventive concepts are not limited thereto.

The multimedia system 1020 may be used when the AP 1001 performs various multimedia functions. The multimedia system 1020 may include a 3D engine module, a video codec, a display system, a camera system, and a post-processor.

In some embodiments, the multimedia system 1020 may supply the image data to the DDI 1080, but aspects of present inventive concepts are not limited thereto. The multimedia system 1020 may be implemented in various manners according to necessity/preference.

The bus 1030 may be used when the CPU 1010, the multimedia system 1020, the memory system 1040, and the peripheral circuit 1050 perform data communication with each other.

In some embodiments, the bus 1030 may have a multi-layer structure. In detail, examples of the bus 1030 may include a multi-layer advanced high-performance bus (AHB) or a multi-layer advanced eXtensible interface (AXI), but aspects of present inventive concepts are not limited thereto.

The memory system 1040 may provide an environment required/beneficial for high-speed operation of the AP 1001 connected to an external memory (for example, DRAM 1060). In some embodiments, the memory system 1040 may include a separate controller (for example, a DRAM controller) for controlling the external memory (for example, DRAM 1060).

The peripheral circuit 1050 may provide environments required/beneficial for the AP 1001 to be smoothly connected to an external device (e.g., a main board). Accordingly, the peripheral circuit 1050 may include various interfaces to be compatible with the external device connected to the AP 1001.

The DRAM 1060 may function as a working memory required for the AP 1001 to operate. In some embodiments, as shown in FIG. 16, the DRAM 1060 may be positioned outside the AP 1001. In detail, the DRAM 1060 may be packaged with the AP 1001 in the form of a package on package (PoP), but aspects of present inventive concepts are not limited thereto.

The DDI 1080 may receive image data from the AP 1001, may buffer the received image data, may generate an image signal and may output the generated image signal to the display unit (e.g., display 1090).

At least one of the semiconductor devices 1 to 6 according to some embodiments of present inventive concepts may be employed as the DDI 1080.

The display unit 1090 may receive the image signal from the DDI 1080 and may output a predetermined image to a display panel.

Figure 17:
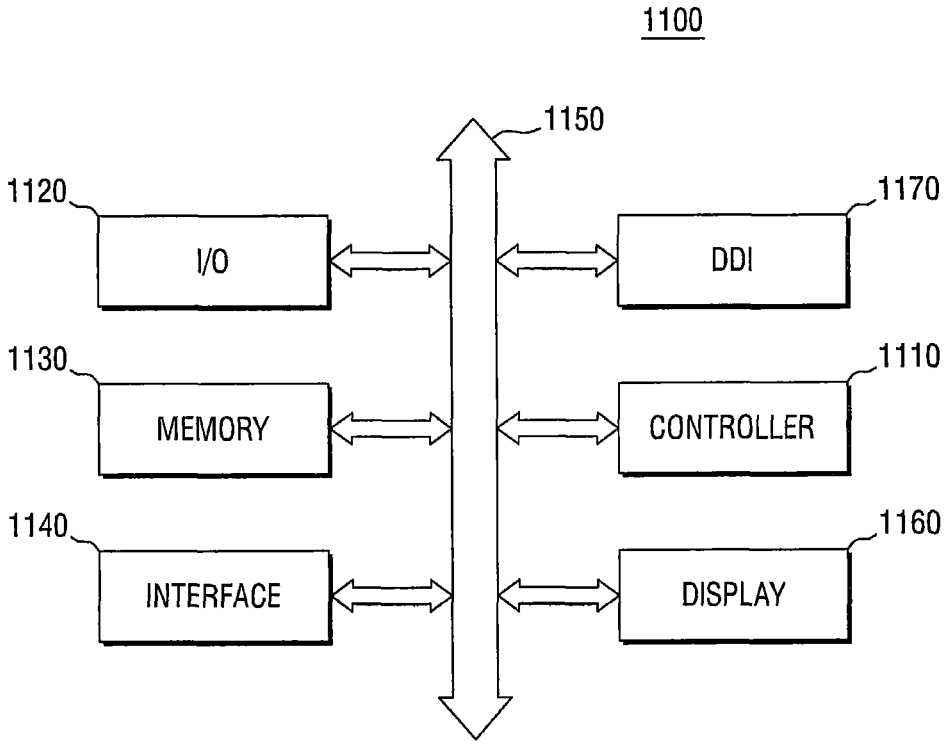
FIG. 17 is a block diagram of an electronic system including semiconductor devices according to some embodiments of present inventive concepts.

FIG. 17 is a block diagram of an electronic system 1100 including semiconductor devices according to some embodiments of present inventive concepts.

Referring to FIG. 17, the electronic system 1100 according to some embodiments of present inventive concepts may include a controller 1110, an input and/or output device (I/O) 1120, a memory device 1130, an interface 1140, a bus 1150, a display driver IC (DDI) 1170, and a display unit 1160. The controller 1110, the I/O 1120, the memory device 1130, the interface 1140, the DDI 170 and/or the display unit 1160 may be connected to one another through the bus 1150. The bus 1150 may function to provide a path through which data may be transferred.

The controller 1110 may include any one of logic devices that can perform functions of at least one of a microprocessor, a digital signal processor, and a microcontroller, or functions similar to those. In some embodiments, the AP (1001 of FIG. 16) may be employed as the controller 1110.

The I/O 1120 may include at least one selected from a key pad, a key board, and a display device.

The memory device 1130 may function to store data and/or instructions performed by the controller 1110.

The interface 1140 may function to transmit/receive data to/from a communication network. The interface 1140 may be in a wired or wireless form. The interface 1140 may include an antenna, wired or wireless transceivers or the like to transmit and receive data by wires or wirelessly.

The DDI 1170 may generate a predetermined image signal for outputting an image to the display unit 1160 and the display unit 1160 may display the image. At least one of the semiconductor devices 1 to 6 according to some embodiments of present inventive concepts may be employed as the DDI 1170.

Moreover, the electronic system 1100 may further include high-speed DRAM and/or SRAM as a working memory for improving the operation of the controller 1110.

The electronic system 1100 may be applied to any one of a personal digital assistant (PDA), a portable computer, a web tablet, a wireless phone, a mobile phone, a digital music player, a memory card, and an information transmitting/receiving system.

Figure 18:
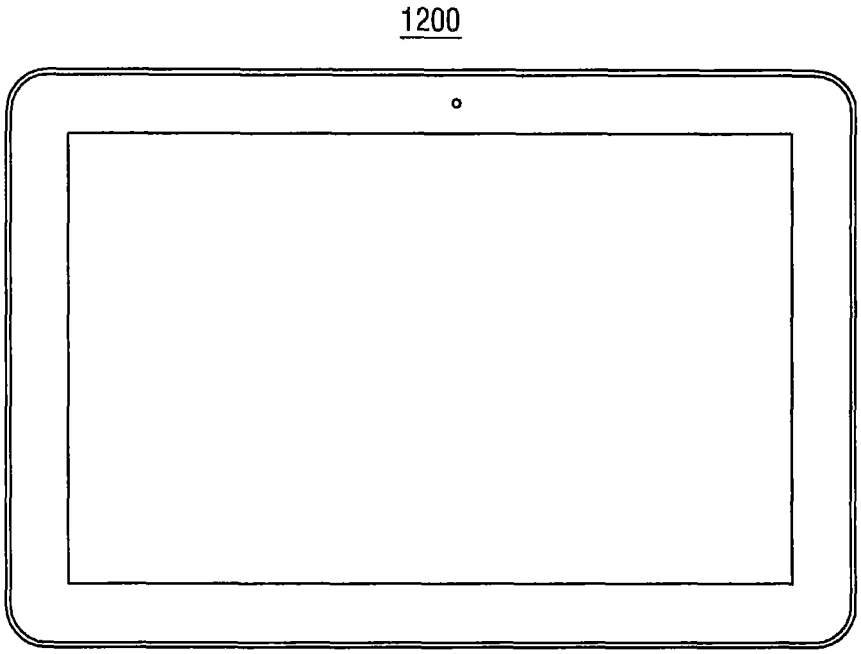
FIGS. 18 to 20 illustrate example semiconductor systems to which semiconductor devices according to some embodiments of present inventive concepts can be applied.
Figure 19:
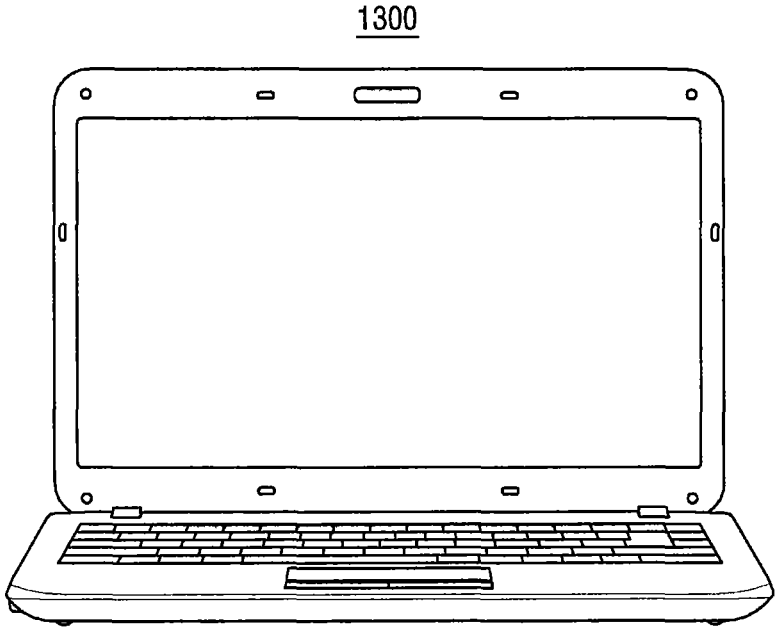
Figure 20:
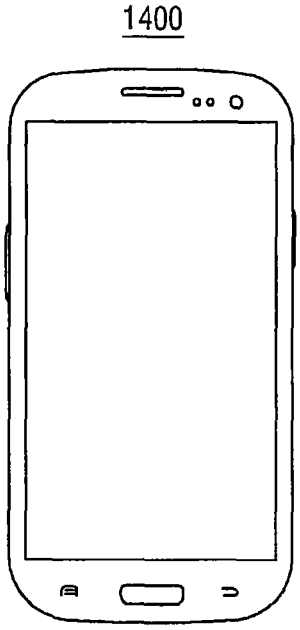

FIGS. 18 to 20 illustrate example semiconductor systems to which semiconductor devices according to some embodiments of present inventive concepts can be applied.

FIG. 18 illustrates an example in which a semiconductor device according to some embodiments of present inventive concepts is applied to a tablet computer (e.g., a tablet personal computer (PC)) 1200, FIG. 19 illustrates an example in which a semiconductor device according to some embodiments of present inventive concepts is applied to a notebook/laptop computer 1300, and FIG. 20 illustrates an example in which a semiconductor device according to some embodiments of present inventive concepts is applied to a smart phone 1400. In addition, one skilled in the art would understand that the semiconductor devices 1 to 6 and 1000 according to some embodiments of present inventive concepts may also be applied to other IC devices not illustrated herein. That is to say, although only the tablet computer 1200, the notebook/laptop computer 1300, and the smart phone 1400 are provided as example semiconductor systems, aspects of present inventive concepts are not limited thereto. In some embodiments, the semiconductor system may be implemented as a computer, an ultra mobile personal computer (UMPC), a work station, a net-book, a personal digital assistant (PDA), a portable computer, a wireless phone, a mobile phone, an e-book, a portable multimedia player (PMP), a portable game console, a navigation device, a digital camera, a 3-dimensional television, a digital audio recorder, a digital audio player, a digital picture recorder, a digital picture player, digital video recorder, a digital video player, or the like.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description.

What is claimed is:

1. A semiconductor device comprising:

a logic circuit configured to receive and buffer image data, and to output the image data that is buffered to a display;

first and second frame buffers, the first frame buffer connected to the logic circuit through a first line comprising a first length, and the second frame buffer connected to the logic circuit through a second line comprising a second length longer than the first length; and conversion circuitry configured to convert the image data into conversion data and to provide the conversion data to the first and second frame buffers, wherein the image data comprises first image data comprising first and second bit sets different from each other and second image data comprising third and fourth bit sets different from each other, wherein the conversion circuitry is configured to receive the image data and to convert the image data into first conversion data comprising the first bit set and the third bit set, and into second conversion data comprising the second bit set and the fourth bit set, wherein the first conversion data is stored in the first frame buffer, and wherein the second conversion data is stored in the second frame buffer.

2. The semiconductor device of claim 1, wherein the first frame buffer is at one side of the logic circuit, and wherein the second frame buffer is at the one side of the logic circuit and is farther than the first frame buffer from the logic circuit.

3. The semiconductor device of claim 1, wherein the conversion circuitry comprises:

a first flip-flop group configured to receive the first bit set of the first image data and the third bit set of the second image data and to output the first bit set of the first image data and the third bit set of the second image data as the first conversion data; and a second flip-flop group configured to receive the second bit set of the first image data and the fourth bit set of the second image data and to output the second bit set of the first image data and the fourth bit set of the second image data as the second conversion data.

4. The semiconductor device of claim 3, wherein the conversion circuitry is within the logic circuit.

5. The semiconductor device of claim 1, wherein the semiconductor device comprises a display driver integrated circuit (DDI); and wherein the image data is supplied from an application processor (AP).

6. The semiconductor device of claim 1, wherein the first conversion data stored in the first frame buffer is refreshed in a first cycle, and wherein the second conversion data stored in the second frame buffer is refreshed in a second cycle longer than the first cycle.

7. A semiconductor device comprising:

a logic circuit configured to receive and buffer image data, and to output the image data that is buffered to a display;

first and second frame buffers, the first frame buffer connected to the logic circuit through a first line comprising a first length, and the second frame buffer connected to the logic circuit through a second line comprising a second length longer than the first length; and conversion circuitry configured to convert the image data into conversion data and to provide the conversion data to the first and second frame buffers, wherein the image data comprises first image data comprising first and second bit sets different from each other and second image data comprising third and fourth bit sets different from each other, wherein the conversion circuitry is configured to receive the image data and to convert the image data into first conversion data comprising the first bit set and the third bit set, and into second conversion data comprising the second bit set and the fourth bit set, wherein the first conversion data is stored in the first frame buffer, wherein the second conversion data is stored in the second frame buffer, wherein the first bit set comprises a least significant bit (LSB) set of the first image data, wherein the second bit set comprises a most significant bit (MSB) set of the first image data, wherein the third bit set comprises an LSB set of the second image data, and wherein the fourth bit set comprises an MSB set of the second image data.

8. The semiconductor device of claim 7, wherein equal numbers of bits are included in the first bit set and the third bit set, and wherein equal numbers of bits are included in the second bit set and the fourth bit set.

9. A semiconductor device comprising:

an application processor (AP); and a display driver integrated circuit (DDI) comprising a logic circuit and first and second frame buffers, wherein the DDI is configured to receive first and second image data from the AP, to convert the first and second image data into first conversion data comprising lower bits of the first and second image data and into second conversion data comprising upper bits of the first and second image data, and to store the first conversion data in the first frame buffer and the second conversion data in the second frame buffer, and wherein at least one of a distance from the logic circuit to the first and second frame buffers and a refresh cycle for the first and second conversion data stored in the first and second frame buffers is different.

10. The semiconductor device of claim 9, wherein the DDI further comprises third and fourth frame buffers, wherein the DDI is further configured to:

receive third and fourth image data from the AP;

convert the third and fourth image data into first conversion data comprising Least Significant Bits (LSBs) of the first to fourth image data, into second conversion data comprising lower bits of the first to fourth image data, into third conversion data comprising upper bits of the first to fourth image data, and into fourth conversion data comprising Most Significant Bits (MSBs) of the first to fourth image data; and store the first to fourth conversion data in the first to fourth frame buffers, respectively, and wherein refresh cycles of the third and fourth frame buffers are longer than refresh cycles of the first and second frame buffers.

11. The semiconductor device of claim 10, wherein the refresh cycle of the fourth frame buffer is longer than the refresh cycle of the third frame buffer, and wherein the refresh cycle of the second frame buffer is longer than the refresh cycle of the first frame buffer.

12. The semiconductor device of claim 9, wherein the DDI further comprises third and fourth frame buffers, wherein the DDI is further configured to:

receive third and fourth image data from the AP;

convert the received third and fourth image data into first conversion data comprising Least Significant Bits (LSBs) of the first to fourth image data, into second conversion data comprising lower bits of the first to fourth image data, into third conversion data comprising upper bits of the first to fourth image data, and into fourth conversion data comprising Most Significant Bits (MSBs) of the first to fourth image data; and store the first to fourth conversion data in the first to fourth frame buffers, respectively, and wherein a distance between each of the third and fourth frame buffers and the logic circuit is longer than a distance between each of the first and second frame buffers and the logic circuit.

13. The semiconductor device of claim 12, wherein the distance between the third frame buffer and the logic circuit is shorter than the distance between the fourth frame buffer and the logic circuit, and wherein the distance between the first frame buffer and the logic circuit is shorter than the distance between the second frame buffer and the logic circuit.

14. The semiconductor device of claim 9, wherein a refresh cycle of the second frame buffer is longer than a refresh cycle of the first frame buffer.

15. The semiconductor device of claim 9, wherein the second frame buffer is farther than the first frame buffer from the logic circuit.

* * * * *